US011369533B2

(12) United States Patent
Kousik et al.

(10) Patent No.: US 11,369,533 B2
(45) Date of Patent: Jun. 28, 2022

(54) BED ASSIST BAR AND METHOD OF MANUFACTURING THE SAME

(71) Applicant: Medline Industries, LP, Northfield, IL (US)

(72) Inventors: Arun Kousik, Northbrook, IL (US); Joseph Ritter, Arlington Heights, IL (US); Frank Martorelli, Hoffman Estates, IL (US)

(73) Assignee: Medline Industries, LP, Northfield, IL (US)

( * ) Notice: Subject to any disclaimer, the term of this patent is extended or adjusted under 35 U.S.C. 154(b) by 0 days.

(21) Appl. No.: 16/883,676

(22) Filed: May 26, 2020

(65) Prior Publication Data

US 2021/0369523 A1 Dec. 2, 2021

(51) Int. Cl.
*A61G 7/053* (2006.01)
*A47C 21/08* (2006.01)

(52) U.S. Cl.
CPC ..... *A61G 7/0533* (2013.01); *A47C 21/08* (2013.01)

(58) Field of Classification Search
CPC .... A47C 21/08; A61G 7/0533; A61G 7/0518; A61G 5/14; F16B 7/20; F16B 12/2009; F16B 2/18
See application file for complete search history.

(56) References Cited

U.S. PATENT DOCUMENTS

| | | | | |
|---|---|---|---|---|
| 4,932,090 | A | 6/1990 | Johansson | |
| 5,231,721 | A | 8/1993 | Fish | |
| 5,586,352 | A * | 12/1996 | O'Brien | A61G 7/053 248/200.1 |
| 5,787,530 | A | 8/1998 | Brix | |
| 7,032,265 | B2 | 4/2006 | Miller | |
| 7,373,679 | B2 | 5/2008 | Miller | |
| 7,640,606 | B2 | 1/2010 | Flannery et al. | |
| 7,805,789 | B1 | 10/2010 | Dean | |
| 7,913,333 | B2 | 3/2011 | Flannery et al. | |
| D701,069 | S | 3/2014 | Miller | |
| 8,973,192 | B2 | 3/2015 | Miller | |
| 9,387,141 | B1 * | 7/2016 | Flannery | A47C 21/08 |
| 9,427,088 | B2 | 8/2016 | Miller | |
| 9,427,089 | B2 | 8/2016 | Marsden et al. | |
| D798,641 | S | 10/2017 | Miller | |
| 9,955,792 | B2 | 5/2018 | Miller | |
| 2002/0118536 | A1 * | 8/2002 | Wu | F21V 21/116 362/219 |
| 2007/0151032 | A1 * | 7/2007 | Heavrin | A47C 21/08 5/662 |
| 2010/0078052 | A1 | 4/2010 | Clark | |
| 2011/0179569 | A1 | 7/2011 | Hayano et al. | |
| 2018/0338627 | A1 * | 11/2018 | Vanburen | A47D 7/02 |
| 2020/0093670 | A1 | 3/2020 | Miller et al. | |

* cited by examiner

*Primary Examiner* — David R Hare
*Assistant Examiner* — Adam C Ortiz
(74) *Attorney, Agent, or Firm* — Philip H. Burrus, IV

(57) ABSTRACT

A bed assist bar includes an undercarriage and a mid-frame attached to the undercarriage. A handle bar is selectively pivotable, using a twist-lock mechanism sub-assembly, between a first position locking the handle bar in a substantially parallel orientation relative to the mid-frame and a second position locking the handle bar being in a substantially orthogonal orientation relative to the mid-frame.

20 Claims, 11 Drawing Sheets

BED ASSIST BAR AND METHOD OF MANUFACTURING THE SAME

BACKGROUND

Technical Field

This disclosure relates generally to human assistance devices, and more particularly to a device for assisting a human into, and out of, a bed.

Background Art

Some people need assistance getting into and/or getting out of a bed. For instance, people with physical disabilities may have trouble getting into or out of the bed. While they may have support devices such as walkers, handrails, and other objects that they can grasp while performing other activities, a residential bed typically includes no such support. Moreover, even for people without disabilities, the low, flat nature of a bed surface can make entry and exit challenging. This challenge can be compounded when the bones or muscle groups tighten after a restful sleep. It would be advantageous to have an improved device that provides accessibility support for people getting into and/or getting out of a bed.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
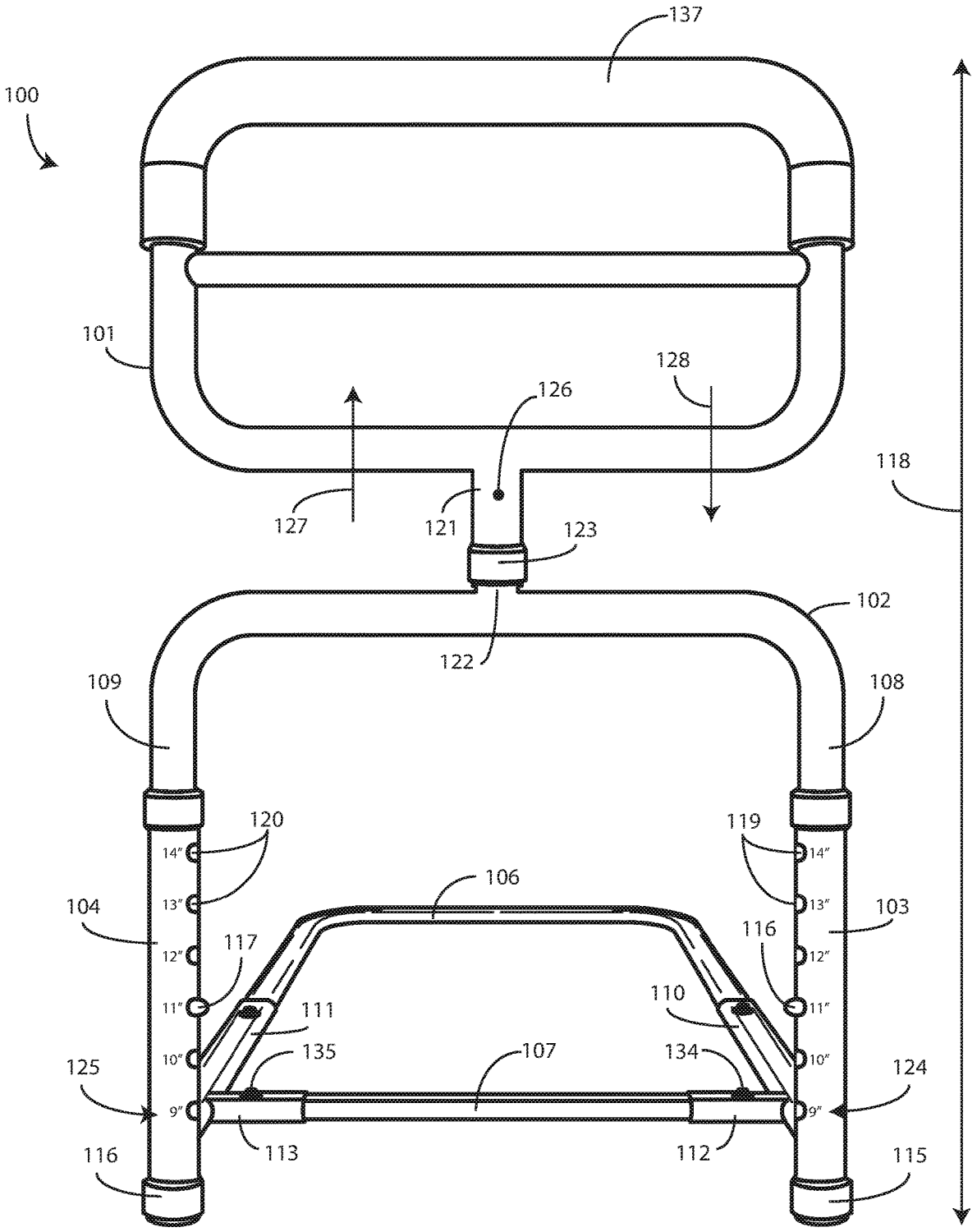
FIG. 1 illustrates one explanatory bed assist bar with the handle bar in a first locked position in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions.

The terms "substantially", "essentially", "approximately", "about" or any other version thereof, are defined as being close to as understood by one of ordinary skill in the art, and in one non-limiting embodiment the term is defined to be within ten percent, in another embodiment within five percent, in another embodiment within one percent and in another embodiment within one-half percent. The term "coupled" as used herein is defined as connected, although not necessarily directly and not necessarily mechanically. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a bed assist bar suitable for providing support to people who require assistance getting into and/or out of a bed. In one or more embodiments, a base defined by a U-bar and cross bar is tucked under a mattress. In one or more embodiments, one or more straps can optionally be coupled to one or more of the U-bar, the cross bar, a U-loop attached to the cross bar, or other feature. Where included these straps can wrap about the frame and/or box spring of the bed to keep the bed assist bar securely in place.

In one or more embodiments, the height that the handle bar of the bed assist bar extends above the box spring and/or mattress is adjustable by adjusting how deeply the mid-frame extensions insert into the legs of the bed assist bar. For example, in one or more embodiments one or more push buttons may extend from within the mid-frame extensions through apertures in the legs. In one or more embodiments, visual indicia indicating a predefined height that the upper cross bar of the handle bar will extend above a standard mattress inform a user regarding with which aperture the push button should align to cause the upper cross bar of the handle bar to extend to that predefined height.

In one or more embodiments, the handle bar can be pivoted and locked in 90-degree increments relative to the mid-frame to better suit the needs of a user. Illustrating by example, in one or more embodiments a twist-lock mechanism sub-assembly is situated between the upper handle bar and the mid-frame of the bed assist bar. The twist-lock mechanism sub-assembly includes a rotating pin that sits within an anchor insert. A head of the rotating pin is biased by a spring toward an upper surface of the anchor insert, which includes several recesses for receiving pins extending distally from the head of the rotating pin.

A user can lift the handle bar slightly away from the mid-frame, thereby compressing the spring and releasing the pins extending distally from the head of the rotating pin from their recesses. The user can then pivot the handle bar while the pins extending distally from the head of the rotating pin are released from their recesses to rotate the handle bar. By releasing the handle bar, the pins extending distally from the head of the rotating pin can again engage in the recesses of the upper surface of the anchor insert, thereby locking the handle bar relative to the mid-frame with the handle bar oriented at different angles relative to the mid-frame. In one or more embodiments, the recesses in the upper surface of the anchor insert allow the handle bar to lock relative to the mid-frame at 90-degree increments such that the user can lock the handle bar in a first position with the handle bar being substantially parallel with the mid-frame or a second position with the handle bar being substantially orthogonal relative to the mid-frame.

In one or more embodiments, a foam grip can be attached to the handle bar for user comfort. Additional accessories can be attached to the bed assist bar as well. For example, in one or more embodiments a storage pouch for small accessories and devices can be attached to the handle bar, the mid-frame, or another location along the bed assist bar. Other accessories suitable for attachment to the bed assist bar will be obvious to those of ordinary skill in the art having the benefit of this disclosure.

In one or more embodiments, a bed assist bar comprises an undercarriage. A mid-frame is attached to the undercarriage. In one or more embodiments, a handle bar is then selectively pivotable between a first position locking the handle bar in a substantially parallel orientation relative to the mid-frame and a second position locking the handle bar being in a substantially orthogonal orientation relative to the mid-frame.

The inclusion of a "pivotable" handle bar offers numerous advantages over prior art support devices. For example, embodiments of the disclosure reduce part counts and therefore are less costly than are prior art bed assist bars that are entrapment compliant. Additionally, bed assist bars configured in accordance with embodiments of the disclosure provide versatility in assisting users in getting in and out of the bed due to the fact that the handle bar can be pivoted relative to the mid-frame and the remainder of the bed assist bar. Embodiments of the disclosure are also height adjustable, thereby being able to function with smaller mattresses, medium-thickness mattresses, and even thicker mattresses such as pillow-tops. The height adjustability offered by embodiments of the disclosure allows the user to set an effective bar height across a wide range of mattress heights.

The simple "lift and twist" mechanism that the twist-lock mechanism sub-assembly provides for the bed assist bar is simple and intuitive to use. There are no latches, buttons, or other external mechanisms that must be awkwardly manipulated to effect the transition of the handle bar from a position where it is substantially parallel with the mid-frame to another position where the handle bar is substantially orthogonal with the mid-frame. In one or more embodiments, the twist-lock mechanism sub-assembly is configures as a completely internal mechanism allowing the user to slightly lift and turn the handle bar in any direction to help them take the first few steps out of bed without bending or straining their wrists. In one or more embodiments, the handle bar locks in 90-degree increments for safety purposes and prevents the user from swinging too far backwards or forwards. Other advantages offered by embodiments of the disclosure will be described below. Still others will be obvious to those of ordinary skill in the art having the benefit of this disclosure.

Turning now to FIG. 1, illustrated therein is one explanatory bed assist bar 100 configured in accordance with one or more embodiments of the disclosure. As shown in FIG. 1, the bed assist bar 100 includes a handle bar 101, a mid-frame 102, one or more legs 103,104, and an undercarriage 105. In this illustrative embodiment, the undercarriage 105 includes a U-bar 106 and a cross bar 107.

In one or more embodiments, each of these components is manufactured from steel. However, embodiments of the disclosure contemplate that other materials could be used as well. Illustrating by example, each of the handle bar 101, mid-frame 102, one or more legs 103,104, and undercarriage 105 could be manufactured from metal, wood, fiberglass, carbon fiber, aluminum, or other materials. In one or more embodiments, the bed assist bar 100 is generally designed, in comparison to other available bed assist devices, to have a low cost and low weight, and, further, to provide improved convenience, comfort, and stability for the user.

In one or more embodiments, each of the handle bar 101, mid-frame 102, one or more legs 103,104, and undercarriage 105 is manufactured from the same material. For example, in one embodiment each component is manufactured from steel. In other embodiments, the components may be manufactured from different materials. For example, the handle bar 101 may be manufactured from carbon fiber so as to be very lightweight, while the mid-frame 102 or other components are manufactured from aluminum or steel, and so forth. Similarly, non-structural components such as the tubing cuffs 115,116 may be manufactured from compliant materials, such as rubber, thermoplastics, or silicone, while the structural components are manufactured from rigid materials such as aluminum or steel.

In one or more embodiments, a covering 137 can be attached to an upper support of the handle bar 101. For example, a rubber foam or sponge type coating can be applied as the covering 137 to make the handle bar 101 softer and more comfortable for a user. Perspiration absorbing materials, antimicrobial materials, friction increasing materials, or other materials can be applied to the covering 137 as well.

In one or more embodiments, the mid-frame 102 includes mid-frame extensions 108,109 that nest within the legs 103,104. In one or more embodiments, each leg 103,104 is configured as a cylinder having an inner diameter slightly larger than an outer diameter of the mid-frame extensions 108,109 that nest within the legs 103,104 so as to slip about, and be able to translate along, the mid-frame extensions 108,109 to allow height-adjustability of the handle bar 101 as will be described in more detail below.

In this illustrative embodiment, the legs 103,104 each include a U-bar receiver 110,111 and a cross bar receiver 112,113. The upper legs of the U-bar 106 insert into the U-bar receivers 110,111, while the cross bar 107 inserts within the cross bar receivers 112,113. These components can be held within their respective receivers frictionally or via one or more fastening devices, e.g., fastening devices 134,145.

In one or more embodiments, the amount by which the upper legs of the U-bar 106 insert into the U-bar receivers 110,111 and/or the cross bar 107 inserts within the cross bar receivers 112,113 is adjustable. For example, in one or more embodiments the upper legs of the U-bar 106 may farther insert into the U-bar receivers 110,111 when the bed assist bar 100 is used with a twin bed, and may insert less into the U-bar receivers 110,111 when the bed assist bar 100 is used with a king size bed, and so forth. In one or more embodiments, the base of each leg 103,104 is fitted with a tubing cuff 115,116 to prevent the legs 103,104 from marring a bedframe or other object. In other embodiments, such as that shown in FIG. 1, the amount by which the upper legs of the U-bar 106 insert into the U-bar receivers 110,111 and/or the cross bar 107 inserts within the cross bar receivers 112,113 is fixed, and is maintained by the fastening devices that pass through the U-bar receivers 110,111 and U-bar 107 and cross bar receivers 112,113 and cross bar 107, respectively.

In one or more embodiments, the overall height 118 of the bed assist bar 100 can be adjusted using a plurality of leg extension apertures 119,120 defined by each leg 103,104. Note that while one set of leg extension apertures 119,120 is shown extending along the interior side of each leg 103,104 in FIG. 1, a complementary set of leg extension apertures can be added on the outer side of each leg 103,104 as well. This illustrative embodiment includes nine apertures in each set of leg extension apertures 119,120.

In one or more embodiments, the mid-frame extensions 108,109 that nest within the legs 103,104 each include a push button 116,117 on each side that is spring biased outwardly from the substantially vertical, lower leg 103,104. The distance of extension of the mid-frame extensions 108,109 into, and out of, the legs 103,104 can be adjusted using these push buttons 116,117. For example, a user can push the push buttons 116,117 toward the legs 103,104 into the mid-frame extensions 108,109 to allow the mid-frame extensions 108,109 to telescope into, and out of, the legs 103,104.

In one embodiment, when the push buttons 116,117 engage the lower-most aperture of the plurality of leg extension apertures 119,120, the bed assist bar 100 is configured for use with a mattress having a thickness of about eight inches or nine inches (or less). By contrast, when the push buttons 116,117 engage an uppermost aperture of the plurality of leg extension apertures 119,120, the bed assist bar 100 is configured for use with a mattress having a thickness of about fourteen inches or more.

As will be described in more detail below with reference to FIG. 7, in one or more embodiments, visual indicia 124,125 can be included along the outer surface of each leg 103,104. In one or more embodiments, the visual indicia 124,125 indicates a predefined height that the upper cross bar of the handle bar 101 will extend above a standard mattress so as to inform a user regarding with which leg extension apertures 119,120 the push button 116,117 should align to cause the upper cross bar of the handle bar 101 to extend to that predefined height. Illustrating by example, in one or more embodiments the upper cross bar of the handle bar 101 is configured to extend about twelve inches above the surface of a mattress having a thickness of between about eight and nine inches. Accordingly, the lower-most indicia, which corresponds to maximum extension of the mid-frame extensions 108,109 into the legs 103-104 may indicate a mattress thickness of eight to nine inches, which informs the user that the upper bar of the handle bar 101 will extend about twelve inches above a mattress of that thickness, and so forth.

When adjustment of the mid-frame extensions 108,109 relative to the legs 103,104 is desired, the user depresses the push buttons 116,117 inward toward the legs 103,104 to release the mid-frame extensions 108,109 from the legs 103,104. The user then slides the mid-frame extensions 108,109 to a desired position, which corresponds to one aperture of the plurality of leg extension apertures 119,120, and allows each push button 116,117 to protrude (or click) into a respective aperture of the plurality of leg extension apertures 119,120 to lock the substantially mid-frame extensions 108,109 relative to the legs 103,104.

Since only one set of leg extension apertures 119,120 is shown extending along the interior side of each leg 103,104 in FIG. 1, in this illustrative example only one push button 116,117 extends from the interior side of the mid-frame extensions 108,109. Had a complementary set of leg extension apertures can be added on the outer side of each leg 103,104, another push button could have been included so as to extend from the exterior side of each mid-frame extension 108,109 as well.

It should also be noted that while push buttons 116,117 are used with the illustrative bed assist bar 100 of FIG. 1, other mechanisms can be used in addition to, or instead of, a push button 116,117. For example, instead of the push button 116,117, a pin or a clip can also be used. Advantageously, the push buttons 116,117 provide an easy mechanism allowing a user to push the push buttons 116,117 into the legs 103,104 to allow the mid-frame extensions 108,109 to telescope into, and out of, the legs 103,104 as desired.

Figure 11:
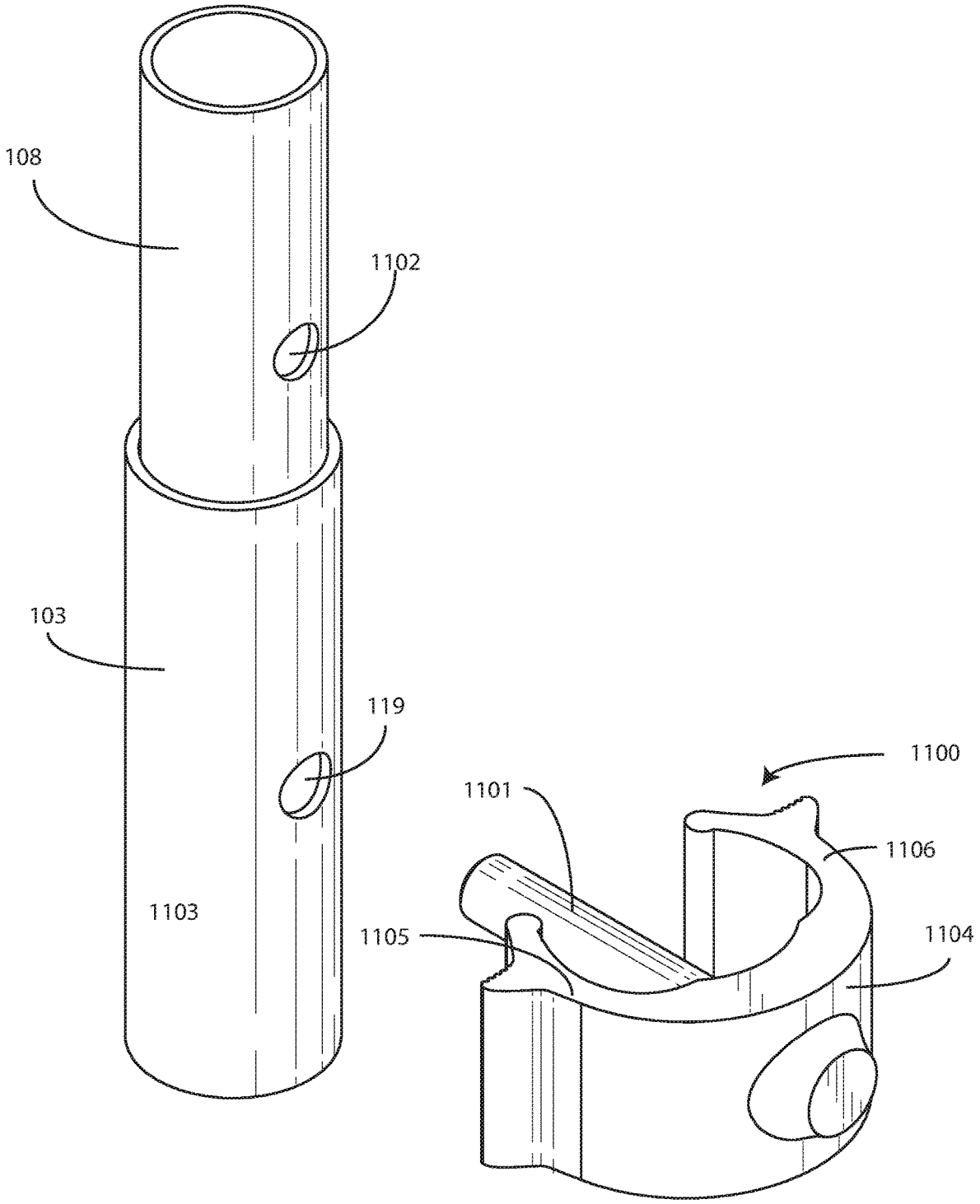
FIG. 11 illustrates one explanatory clip suitable for use with a bed assist bar configured in accordance with one or more embodiments of the disclosure.

Other mechanisms will be obvious to those of ordinary skill in the art having the benefit of this disclosure. Illustrating by example, turning briefly to FIG. 11, illustrated therein is one explanatory retaining clip 1100 that can be used in place of a push buttons (116,117) to allow the mid-frame extensions 108 to be adjusted within the legs 103 to a desired position. One example of this clip 1100 is described in commonly assigned U.S. Pat. No. 10,278,886, which is incorporated herein by reference. The retaining clip 1100 includes a engagement post 1101 that can be inserted into the aperture 119 of the leg 103 and a corresponding aperture 1102 defined by the mid-frame extensions 108 to securely coupled the two components together and lock the mid-frame extensions 108,109 relative to the legs 103,104 at the desired height.

In one or more embodiments, the retaining clip 1100 can removably engage an outer surface 1103 of the leg 103. In one embodiment, the retaining clip 1100 includes a base member 1104, a first, curved, cantilevered leg 1105, and a second, curved, cantilevered leg 1106. In the illustrative embodiment of FIG. 11, the base member 1104 is curved about a central axis passing orthogonally through the engagement post 1101 so as to define an arched base member. In one embodiment, the first, curved, cantilevered leg 1105 extends from a first side of the base member 1104. Similarly, the second, curved, cantilevered leg 1106 extends from a second side of the base member 1104.

In one embodiment, the base member 1104, the first, curved, cantilevered leg 1105, and the second, curved, cantilevered leg 1106 are manufactured from a unitary pliant material such that the first, curved, cantilevered leg 1105 and the second, curved, cantilevered leg 1106 can selectively deflect outwardly from a central axis of the retaining clip 1100. This allows each of the first, curved, cantilevered leg 1105 and the second, curved, cantilevered leg 1106 to deflect about the leg 103 and then grasp the same therein to attach the retaining clip 1100 to the leg 103.

For example, in one embodiment the base member 1104, the first, curved, cantilevered leg 1105 and the second, curved, cantilevered leg 1106 are manufactured from a hard rubber material such as styrene-butadiene rubber. Other materials will be obvious to those of ordinary skill in the art having the benefit of this disclosure. For example in another embodiment, the unitary pliant material can be a pliant thermoplastic material. The use of the pliant material serves multiple purposes. As noted above, it allows the first, curved, cantilevered leg 1105 and the second, curved, cantilevered leg 1106 to deflect about the leg 103 when attaching the retaining clip 1100 to the outer surface 1103 of the leg 103. However, the use of a pliant material also helps to withstand impact if the retaining clip 1100 receives an impact force.

In one embodiment, the retaining clip 1100 can be color-coded. For example, in one embodiment, the base member 1104, the first, curved, cantilevered leg 1105, the second, curved, cantilevered leg 1106 all have a common color, such as black, red, or blue. In other embodiments, the base member 1104, the first, curved, cantilevered leg 1105, the second, curved, cantilevered leg 1106 have a different color.

Turning now back to FIG. 1, in one or more embodiments a single stem 121 couples the handle bar 101 to the mid-frame 102. In this illustrative embodiment, the mid-frame 102 includes a single stem 122 that is narrower in diameter than the single stem 121 extending from the handle bar 101. This allows the single stem 122 extending from the mid-frame 102 to seat within the single stem 121 extending from the handle bar 101, thereby allowing the interior perimeter of the single stem 121 extending from the handle bar 101 to pivot about the outer perimeter of the single stem 122 extending from the mid-frame 102. A tubing cuff 123 covers the intersection of the lower most edge of the single stem 121 extending from the handle bar 101 as it sits about the single stem 122 extending from the mid-frame 102.

As will be explained in more detail with reference to FIGS. 4 and 5, in one or more embodiments a twist-lock mechanism sub-assembly is situated within the single stem 121 extending from the handle bar 101 and the single stem 122 extending from the mid-frame 102. In one or more embodiments, a washer assembly then anchors an anchor insert of the twist-lock mechanism sub-assembly to the horizontal bar of the mid-frame 102, while a connector pin 126 anchors a rotating pin of the twist-lock mechanism sub-assembly to the single stem 121 extending from the handle bar 101.

In one or more embodiments, the handle bar 101 can advantageously be pivoted and locked in 90-degree increments relative to the mid-frame 102 to better suit the needs of a user. Illustrating by example, in one or more embodiments the rotating pin of the twist-lock mechanism sub-assembly, which is attached to the handle bar 101, sits within an anchor insert of the twist-lock mechanism sub-assembly, which is fixedly attached to the mid-frame 102. A head of the rotating pin is biased by a spring toward an upper surface of the anchor insert, which includes several recesses for receiving pins extending distally from the head of the rotating pin when the twist-lock mechanism sub-assembly is in the rest position, i.e., when forces are not compressing the spring of the twist-lock mechanism sub-assembly.

In one or more embodiments, a user can lift 127 the handle bar 101 slightly away from the mid-frame 102, thereby compressing the spring and releasing the pins extending distally from the head of the rotating pin from their recesses. The user can then pivot the handle bar 101 while the pins extending distally from the head of the rotating pin are released from their recesses to rotate the handle bar 101 relative to the mid-frame 102.

By releasing 128 the handle bar 101, the pins extending distally from the head of the rotating pin can again engage in the recesses of the upper surface of the anchor insert, thereby locking the handle bar 101 relative to the mid-frame 102. In one or more embodiments, the handle bar 101 locks relative to the mid-frame 102 at one or more predefined angles. Illustrating by example, in one or more embodiments, the recesses in the upper surface of the anchor insert allow the handle bar 101 to lock relative to the mid-frame 102 at 90-degree increments such that the user can lock the handle bar 101 in a first position, shown in FIG. 1, with the handle bar 101 being substantially parallel with the mid-frame 102.

Figure 2:
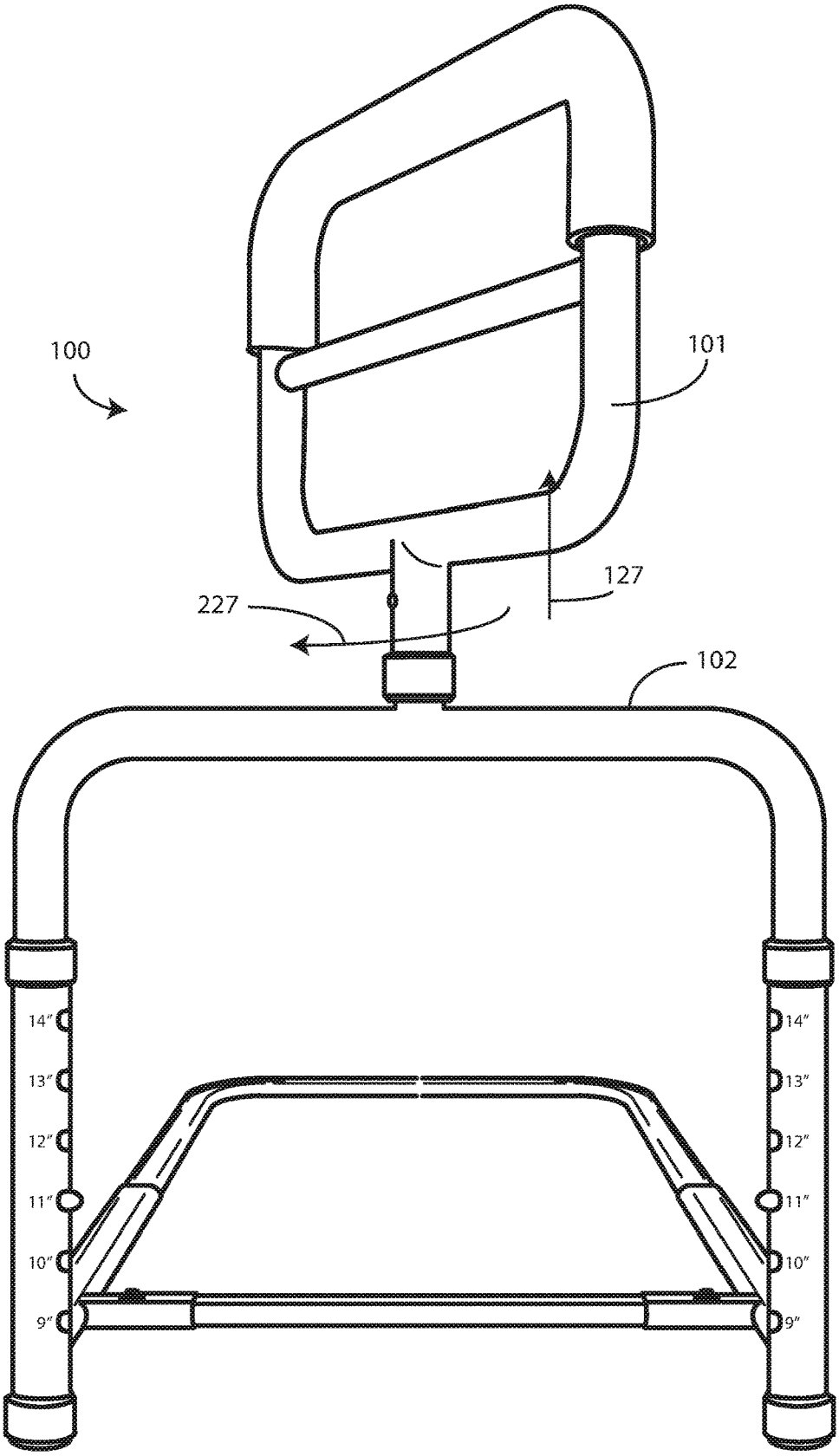
FIG. 2 illustrates one explanatory bed assist bar with the handle bar in a lifted and partially rotated position in accordance with one or more embodiments of the disclosure.

FIG. 2 then illustrates the handle bar after being lifted 127 slightly away from the mid-frame 102, thereby compressing the spring and releasing the pins extending distally from the head of the rotating pin from their recesses. As shown in FIG. 2, the handle bar 101 is then free to pivot 227 relative to the mid-frame 102 while the pins extending distally from the head of the rotating pin are released from their recesses.

Figure 3:
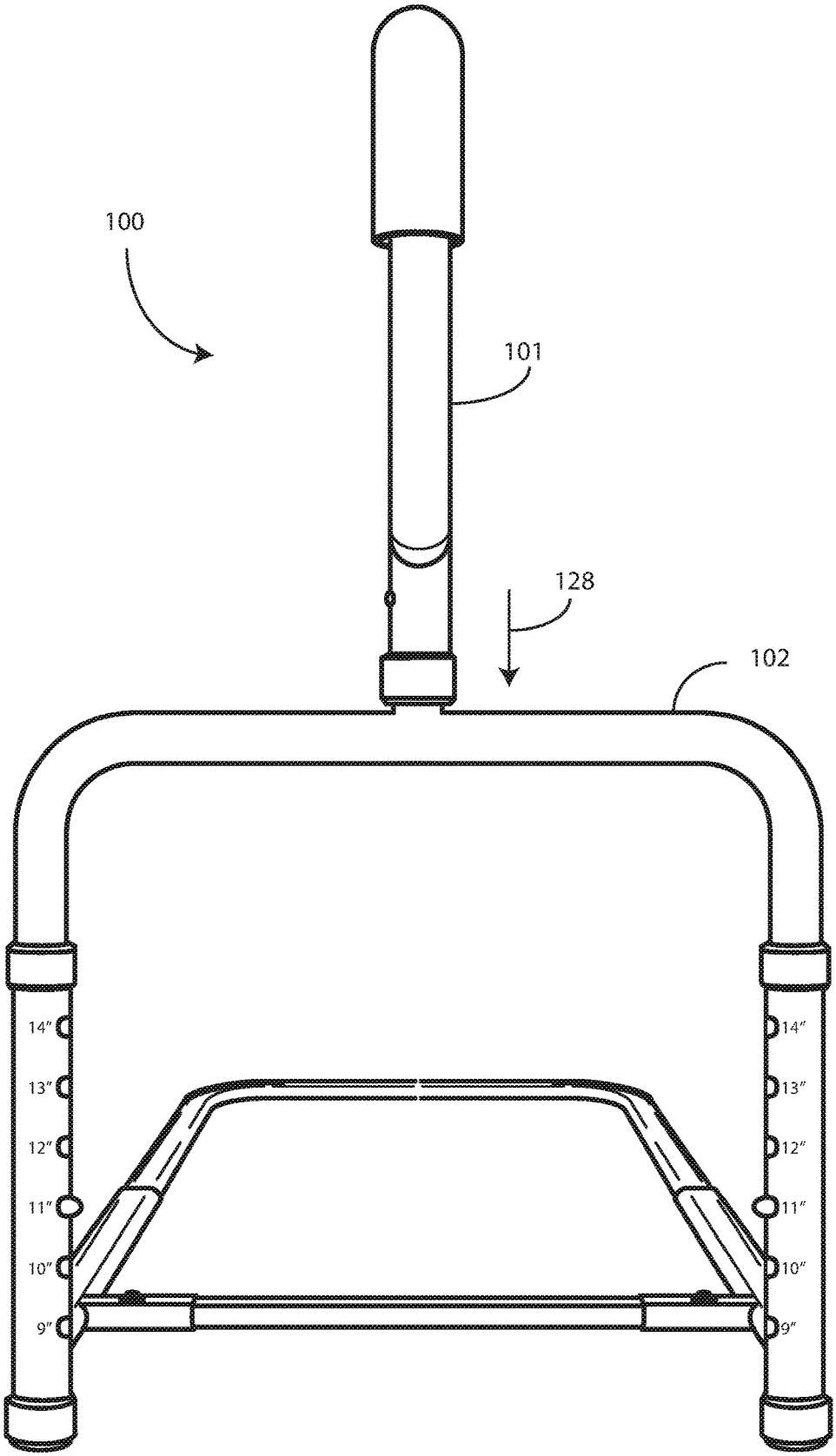
FIG. 3 illustrates one explanatory bed assist bar with the handle bar in a second locked position in accordance with one or more embodiments of the disclosure.

However, as shown in FIG. 3, by releasing 128 the handle bar 101, the pins extending distally from the head of the rotating pin can again engage in the recesses of the upper surface of the anchor insert, thereby locking the handle bar 101 relative to the mid-frame 102. In one or more embodiments, the handle bar 101 locks relative to the mid-frame 102 at one or more predefined angles. Illustrating by example, in one or more embodiments, the recesses in the upper surface of the anchor insert allow the handle bar 101 to lock relative to the mid-frame 102 at 90-degree increments such that the user can lock the handle bar 101 in a first position, shown in FIG. 1, with the handle bar 101 being substantially parallel with the mid-frame 102, or a second position, shown in FIG. 3, with the handle bar 101 being oriented substantially orthogonally with the mid-frame 102.

In one or more embodiments, the handle bar 101 can pivot freely in either direction such that it cab be pivoted 227, as shown in FIG. 2, either in the clockwise direction or the counter clockwise direction to transition from the first position of FIG. 1 to the second position of FIG. 3. This advantageously allows the bed assist bar 100 to be positioned on either the right side of a bed or the left side of a bed, as well as to be operated by either a right handed user or a left handed user with equal ease. The advantageous use of a single stem to connect the handle bar 101 to the mid-frame 102, with the twist-lock mechanism sub-assembly situated therein, provides a simple, effective, secure, and intuitive system allowing the handle bar 101 to be locked parallel to the mid-frame 102 or perpendicular to the mid-frame 102 as desired by the user.

Advantageously, the twist-lock mechanism sub-assembly provides a completely internal mechanism that allows the user to slightly lift and turn the handle bar 101 in any direction to help them take the first few steps out of bed without bending or straining their wrists. As noted above, in one or more embodiments the handle bar 101 is designed to lock in 90-degree increments for additional safety. This locking action additionally prevents the user from swinging the handle bar 101 too far backwards or forwards relative to the mid-frame 102.

Figure 4:
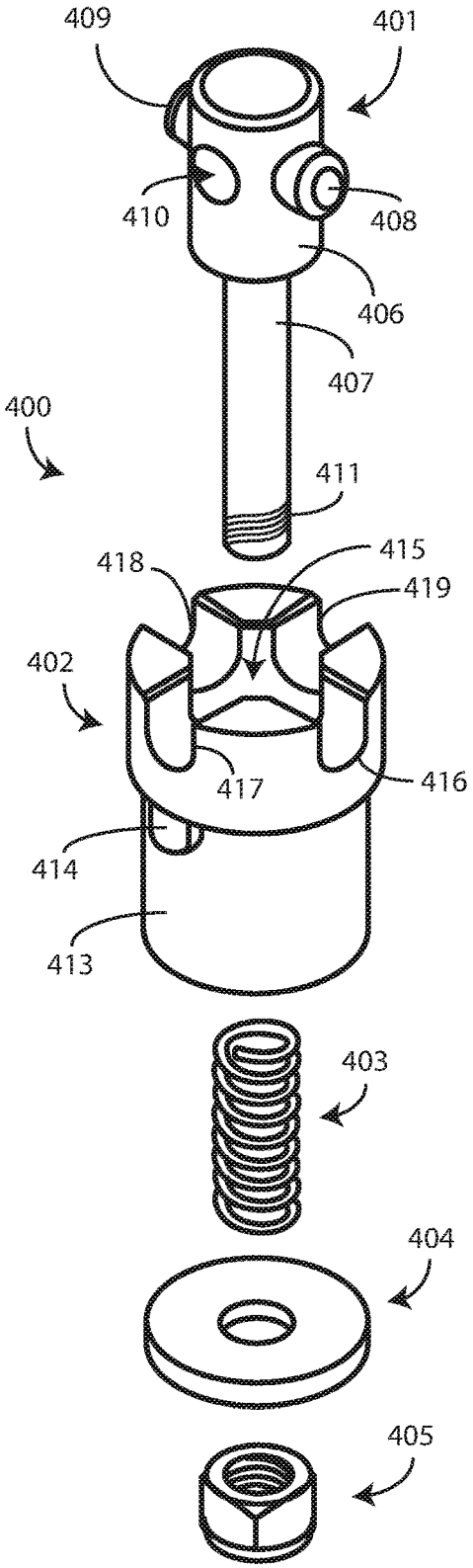
FIG. 4 illustrates an exploded view of one explanatory twist lock mechanism in accordance with one or more embodiments of the disclosure.
Figure 5:
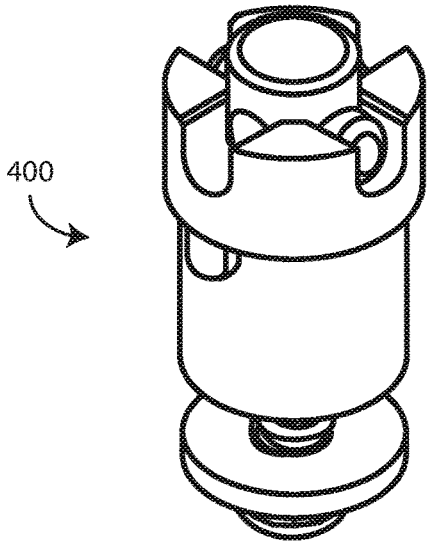
FIG. 5 illustrates an assembled view of one explanatory twist lock mechanism in accordance with one or more embodiments of the disclosure.

Turning now to FIGS. 4 and 5, illustrated therein is one explanatory twist-lock mechanism sub-assembly 400 configured in accordance with one or more embodiments of the disclosure. The twist-lock mechanism sub-assembly 400 is shown in an exploded view in FIG. 4, and in an assembled view in FIG. 5.

In one or more embodiments, the twist-lock mechanism sub-assembly includes a rotating pin 401, an anchor insert 402, a spring 403, a washer 404, and a fastener, which is shown in this illustrative embodiment as a hex nut 405. While a hex nut 405 is used in this illustrative embodiment, it will be clear to those of ordinary skill in the art having the benefit of this disclosure that other fasteners can be used as well. For example, a Cotter pin or other fastener can be used in place of the hex nut 405.

In one or more embodiments, the rotating pin 401 includes a head 406 and a shaft 407. As shown in FIG. 4, in one or more embodiments the head 406 has a diameter that is greater than the diameter of the shaft 407. The shaft 407 extends distally away from the head 406. In this illustrative embodiment, the shaft 407 terminates at a threaded end member 411 configured to engage the hex nut 405. Where another fastener is substituted for the hex nut 405, the threaded end member 411 can be reconfigured. For example, if a Cotter pin is substituted for the hex nut 405, the distal end of the shaft 407 might include a hole rather than threads, and so forth.

In one or more embodiments, one or more pins 408,409 extend distally from an outer perimeter of the head 406 of the rotating pin 401. In this illustrative example, the one or more pins 408,409 comprise two pins that extend distally from the outer surface of the head 401 of the rotating pin 401 in opposite directions along an axis that is oriented substantially orthogonally with the major axis of the shaft 407 of the rotating pin 401. In this illustrative embodiment, the head 406 also includes an aperture 410 through which a coupling pin (126) may pass to fixedly couple the head 406 of the rotating pin 401 to the single shaft (121) of the handle bar (101) as previously described.

The anchor insert 402 includes an upper member 412 and a lower member 413. In this illustrative example, the upper member 412 has a diameter that is greater than that of the lower member 413. The upper member 412 also includes one or more stops 414 extending distally away from a lower surface of the upper member 412 along the outer surface of the lower member 413 of the anchor insert 402. As will be described below with reference to FIG. 6, in one or more embodiments this stop 414 situates within a recess defined by a terminal edge of the single shaft (122) extending from the mid-frame (102) to prevent the twist-lock mechanism sub-assembly 400 from pivoting relative to the mid-frame (102) when the handle bar (101) is rotated.

In one or more embodiments, the anchor insert 402 defines a central bore 415 along its major axis through which the shaft 407 of the rotating pin 401 may pass when the twist-lock mechanism sub-assembly 400 is assembled. In one or more embodiments, to assemble the twist-lock mechanism sub-assembly 400, the shaft 407 is passed through the central bore 415 and then through the spring 403 and washer, where the threaded end member 411 of the shaft 407 engages the hex nut 405. This assembled version of the twist-lock mechanism sub-assembly 400 is shown in FIG. 5. When assembled, the spring 403 is preloaded to bias the head 406 of the rotating pin 401 toward the anchor insert 402 in a rest position.

As best seen in FIG. 4, in one or more embodiments the upper member 412 of the anchor insert 402 defines one or more recesses 416,417,418,419 into which the pins 408,409 or the connecting pin (126) may situate. In this illustrative embodiment, the upper member 412 of the anchor insert 402 defines four recesses 416,417,418,419, which allow the pins 408,409 of the rotating pin 401 to situate in one of two positions, which are each rotated 90-degrees out of phase with the other. When, for example, the pins 408,409 situate in recesses 416,418, this allows the handle bar (101) to which the rotating pin 401 is coupled, to situate in the first position shown in FIG. 1 where the handle bar (101) is oriented substantially parallel with the mid-frame (102). By contrast, when the pins 408.409 situate in recesses 417,419, this allows the handle bar (101) to which the rotating pin 401 is coupled, to situate in the second position shown in FIG. 3 where the handle bar (101) is oriented substantially orthogonally with the mid-frame (102).

As previously explained, the twist-lock mechanism sub-assembly 400 allows the handle bar (101) of a bed assist bar (100), to which the rotating pin 401 is coupled, to pivot and lock in 90-degree increments relative to the mid-frame (102), to which the anchor insert 402 is coupled by the washer 404, with the stop 414 preventing the anchor insert 402 from rotating within the single stem (122) extending from the (102).

When a user lifts (127) 127 the handle bar (101) away from the mid-frame (102), in one or more embodiments this causes the spring 403 to compress, i.e., leave its rest condition and enter a loaded condition, thereby allowing the shaft 407 of the rotating pin to translate within the central bore 415 of the anchor insert 402. When the spring 403 is sufficiently compressed that the pins 408,409 extending distally from the head 406 of the rotating pin 401 release from the recesses 416,417,418,419 of the anchor insert 402, the shaft 407 of the rotating pin 401 is allowed to pivot within the central bore 415 of the anchor insert 402. This allows a user to pivot the handle bar (101) while the pins 408,409 extending distally from the head 406 of the rotating pin 401 are released from their recesses 416,417,418,419 relative to the mid-frame (102).

When the handle bar (101) is released (128), the spring 403 expands and returns to the rest position, biasing the shaft 407 of the rotating pin 401 back into the central bore 415 of the anchor insert 402. This causes the pins 408,409 extending distally from the head 406 of the rotating pin 401 can again engage in the recesses 416,417,418,419 of the upper surface of the anchor insert 402, thereby locking the handle bar (101) relative to the mid-frame (102). The one or more pins 408,409 of the rotating pin 401 are thus configured to situate within the one or more recesses 416,417,418.419 when in a rest position.

Since there are four recesses 416,417,418,419 in the upper member 412 of the twist-lock mechanism sub-assembly 400 in this embodiment, the handle bar (101) locks relative to the mid-frame (102) at one of two orthogonal angles in this illustrative embodiment. However, in other embodiments, more recesses, or fewer recesses, can be included to allow the handle bar (101) to lock relative to the mid-frame (102) at other angles as well. When four recesses 416,417,418,419 are used, the handle bar (101) locks relative to the mid-frame (102) at one of two 90-degree-apart increments such that the user can lock the handle bar (101) in a first position, shown in FIG. 1, with the handle bar (101) being substantially parallel with the mid-frame (102), or alternatively the second position, shown in FIG. 3, with the handle bar (101) being substantially orthogonally oriented with the mid-frame (102). In one or more embodiments, the rotating pin 401 can pivot freely in either direction relative to the anchor insert 402.

Figure 6:
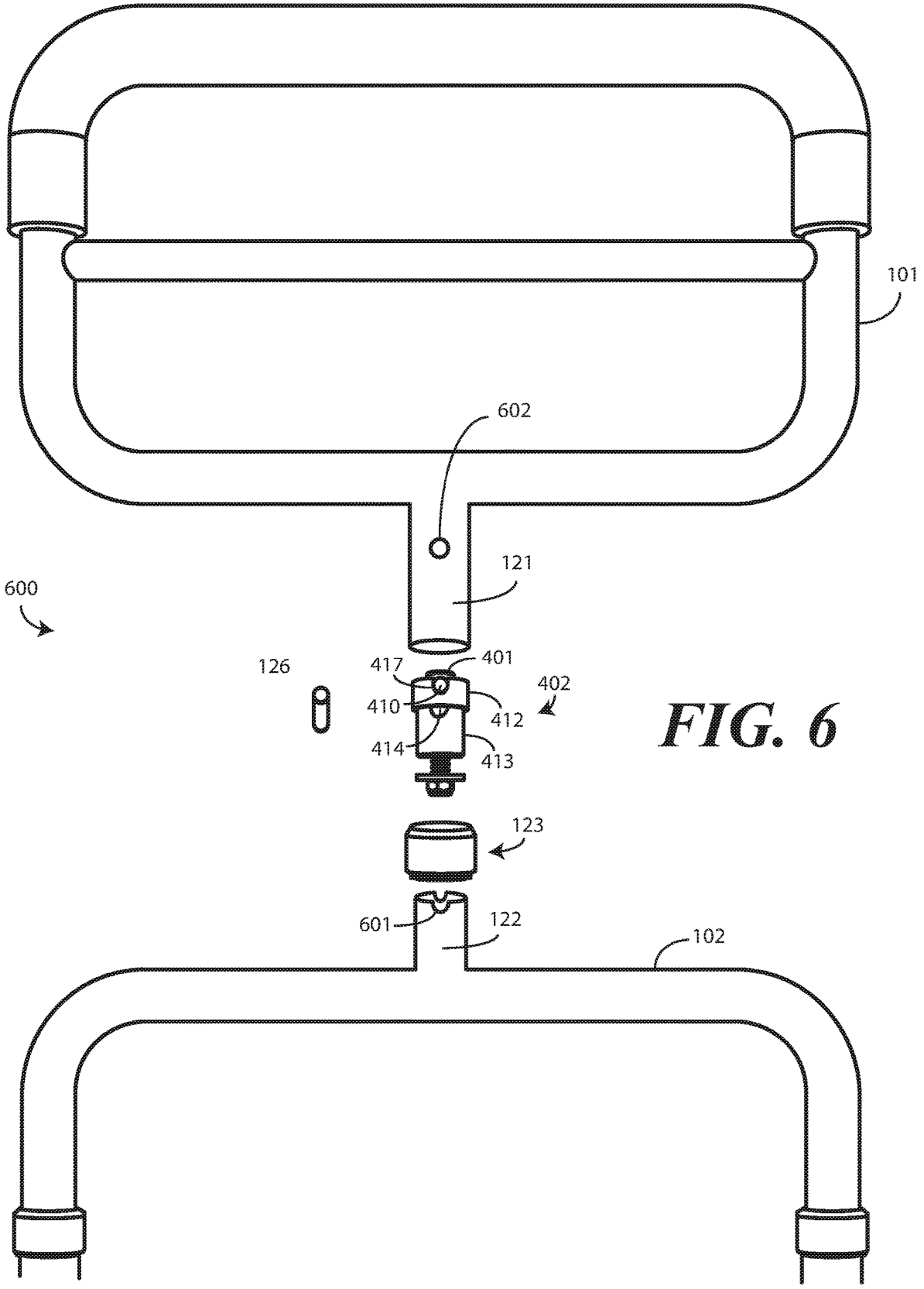
FIG. 6 illustrates an exploded view of a subassembly of one explanatory bed assist bar in accordance with one or more embodiments of the disclosure.

Turning now to FIG. 6, illustrated therein is an exploded view of the pivoting assembly 600 of the bed assist bar (100) of FIG. 1. This includes the handle bar 101, the mid-frame 102, and the twist-lock mechanism sub-assembly 400. Also shown in FIG. 6 are the tubing cuff 123 and the connector pin 126.

Recall from above that in one or more embodiments the upper member 412 of the twist-lock mechanism sub-assembly 400 includes one or more stops 414 extending distally away from a lower surface of the upper member 412 along the outer surface of the lower member 413 of the anchor insert 402. In one or more embodiments, when the twist-lock mechanism sub-assembly 400 is positioned within the bore defined by the single stem 122 of the mid-frame 102, this stop 414 situates within a recess 601 defined by a terminal edge of the single stem 122 extending from the mid-frame 102. By situating within this recess 601, the stop 414 prevents the twist-lock mechanism sub-assembly 400 from pivoting relative to the mid-frame 102 when the handle bar 101 is rotated.

In one or more embodiments, the lower member 413 of the twist-lock mechanism sub-assembly 400 can be coated with an adhesive so that the twist-lock mechanism sub-assembly 400 is retained within the single stem 122 of the mid-frame 102 when the assembly is completed and the handle bar 101 is lifted (127) as described above with reference to FIGS. 1-3. In other embodiments, the lower member 413 of the twist-lock mechanism sub-assembly 400 can be frictionally fit within the single stem 122 of the mid-frame 102. For example, a rubber gasket or seal can be fitted about the lower member 413 of the twist-lock mechanism sub-assembly 400 to frictionally retain the twist-lock mechanism sub-assembly 400 in the single stem 122 of the mid-frame 102. Bolts, pins, or other fasteners can be used as well. Other techniques for retaining the twist-lock mechanism sub-assembly 400 within the single stem 122 of the mid-frame 102 will be obvious to those of ordinary skill in the art having the benefit of this disclosure.

In FIG. 6, the rotating pin 401 has been situated within the bore (415) defined by the anchor insert 402 with the pins 408,409 situated within recesses (416,418). This leaves the aperture 410 aligned with the other recesses 417,(419). When bore defined by the single stem 121 of the handle bar 101 is positioned about the upper member 412 of the twist-lock mechanism sub-assembly 400, with an aperture 602 of the single stem 121 of the handle bar 101 aligned with the aperture 410 of the rotating pin 401, the coupling pin 126 can be inserted such that it sits within recesses 417,(419). Passing the coupling pin 126 through both apertures fixedly couples the head (406) of the rotating pin 401 to the single stem 121 of the handle bar 101 as previously described.

In this illustrative embodiment, the upper member 412 of the anchor insert 402 defines four recesses (416),417,(418, 419), which allow the pins (408,409) of the rotating pin 401 to situate in one of two positions, which are each rotated 90-degrees out of phase with the other. When, for example, the pins (408,409) situate in recesses (416,418), this allows the handle bar 101 to which the rotating pin 401 is coupled, to situate in the first position shown in FIG. 1 where the handle bar 101 is oriented substantially parallel with the mid-frame 102. By contrast, when the pins (408,409) situate in recesses 417,(419), this allows the handle bar 101 to which the rotating pin 401 is coupled to situate in the second position shown in FIG. 3 where the handle bar 101 is oriented substantially orthogonally with the mid-frame 102.

This allows the handle bar 101 to be lifted (127) and rotated (227). For example, if the handle bar 101 is pulled away from the mid-frame 102 and rotated (227) by 90 degrees, and then released, the coupling pin 126 would transition from being situated in recesses 417,(419) to being situated in recesses (416,418). Meanwhile, pins (408,409) would transition from being situated in recesses (416,418) to being situated within recesses 417,(419), and so forth.

It should be noted that while FIG. 6 illustrates the rotating pin 401 being coupled to the single stem 121 extending distally from the handle bar 101, and with the lower member 413 of the anchor insert 402 being coupled to the single stem 122 extending distally from the mid-frame 102, it will be obvious to those of ordinary skill in the art having the benefit of this disclosure that the twist-lock mechanism sub-assembly 400 could simply be turned upside down as well, with the rotating pin 401 coupled to the single stem 122 extending from the mid-frame 102 and the lower member 413 of the anchor insert 402 being coupled to the single stem 121 extending from the handle bar 101, as this would offer an equivalent operation. Thus, it should be understood that embodiments of the disclosure contemplate the twist-lock mechanism sub-assembly 400 comprising a rotating pin 401 comprising a head (406) coupled to one of the handle bar 101 or the mid-frame 102, and an anchor insert 402 having a lower member 413 coupled to another of the handle bar 101 or the mid-frame 102, wherein the head (406) is spring biased toward the anchor insert 402.

Figure 7:
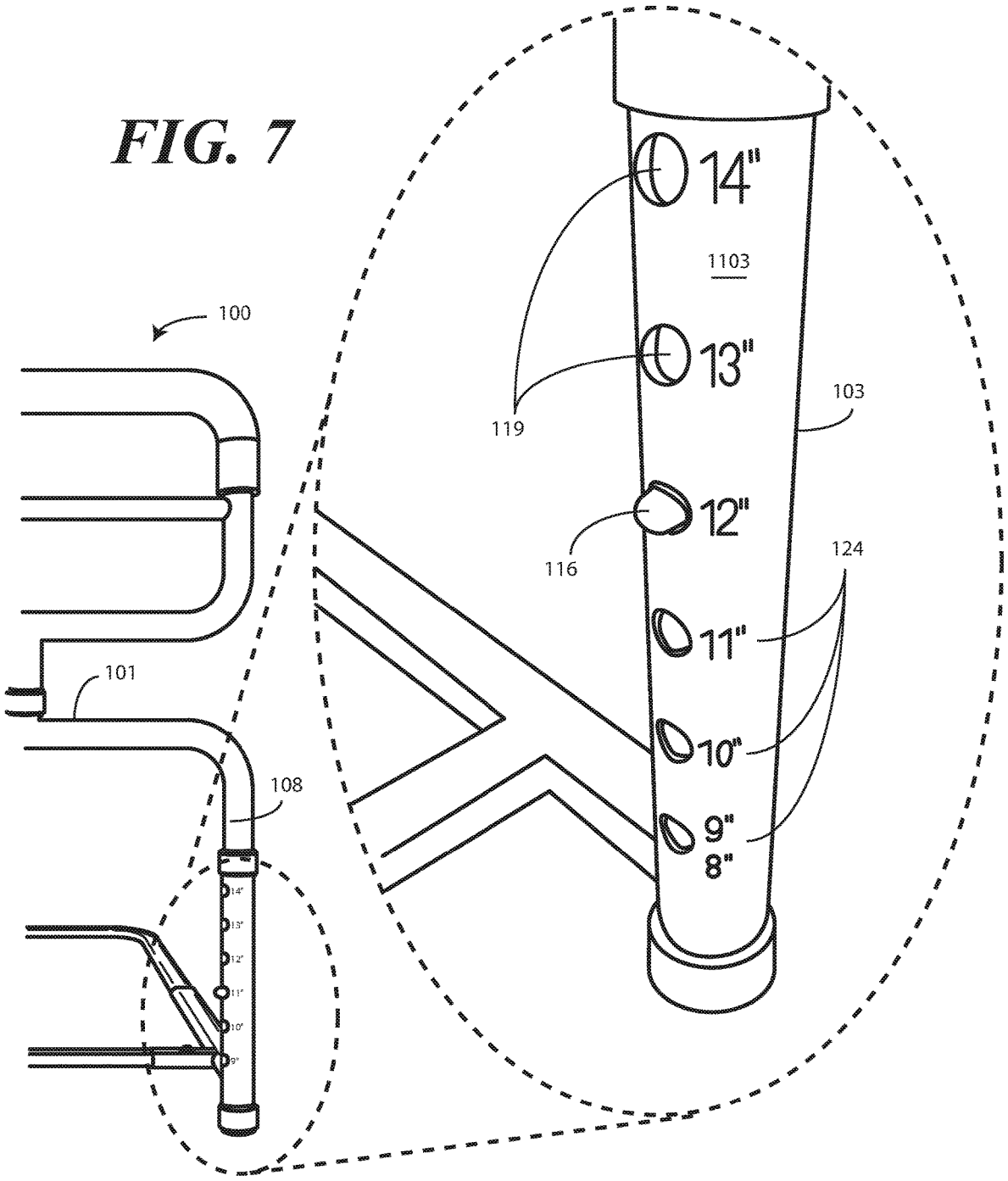
FIG. 7 illustrates an enlarged view of another subassembly of one explanatory bed assist bar in accordance with one or more embodiments of the disclosure.

Turning now to FIG. 7, illustrated therein is an expanded view of one leg 103 of the bed assist bar 100. As noted above, in one or more embodiments the height (118) that the handle bar 101 of the bed assist bar 100 extends above the box spring and/or mattress is adjustable by adjusting how deeply the mid-frame extensions 108,(109) insert into the legs 103,(104) of the bed assist bar 100. For example, using either the push buttons 116,(117), the retaining clip (1100), or another coupling device, the height (118) can be adjusted by passing the coupling device through a different aperture of the one or more apertures 119,(120).

To assist the user in estimating what the proper height should be to meet entrapment compliance regulations, in one or more embodiments, visual indicia 124,(125) can be included along the outer surface 1103 of each leg 103,(104). One example of this visual indicia 124,(125) is shown in FIG. 7.

In one or more embodiments, the visual indicia 124,(125) indicates a predefined height that the upper cross bar of the handle bar 101 will extend above a mattress having a predefined thickness. Accordingly, the visual indicia 124, (125) serve to inform a user regarding with which leg extension apertures 119,(120) the coupler, be it a push button 116,(117), retaining clip (1100), or other coupler, should align to cause the upper cross bar of the handle bar 101 to extend to that predefined height.

Illustrating by example, in one or more embodiments the upper cross bar of the handle bar 101 is configured to extend about twelve inches above the surface of a mattress having a thickness of between about eight and nine inches. Accordingly, the lower-most indicia, which corresponds to maximum extension of the mid-frame extensions 108,(109) into the legs 103,(104) may indicate a mattress thickness of eight to nine inches, which informs the user that the upper bar of the handle bar 101 will extend about twelve inches above a mattress of that thickness, and so forth.

When adjustment of the mid-frame extensions 108,(109) relative to the legs 103,(104) is desired, the user removes the retaining clip (1100), depresses the push buttons 116,(117) inward toward the legs 103,(104), or takes another action (depending upon the coupler employed) to release the mid-frame extensions 108,(109) from the legs 103,(104). The user then slides the mid-frame extensions 108,(109) to a desired position, which corresponds to one aperture of the plurality of leg extension apertures 119,(120). Where the coupler is the retaining clip (1100) this would include aligning the aperture 1102 of the mid-frame extensions 108,(109) and inserting the engagement post (1101) into the desired aperture of the plurality of leg extension apertures 119,(120) on the legs 103,(104) and the apertures 1104 of the mid-frame extension 108,(109). Where the coupler is a push button 116,(117), a user would simply allow each push button 116,(117) to protrude (or click) into a respective aperture of the plurality of leg extension apertures 119,(120) to lock the substantially mid-frame extensions 108,(109) relative to the legs 103,104.

In one or more embodiments, when the push buttons 116,(117) or engagement post (1101) of the retaining clip (1100) engage the lower-most aperture of the plurality of leg extension apertures 119,(120), the bed assist bar 100 is configured for use with a mattress having a thickness of about eight inches or nine inches (or less). By contrast, when the push buttons 116,(117) or engagement post (1101) of the retaining clip (1100) engage an uppermost aperture of the plurality of leg extension apertures 119,(120), the bed assist bar 100 is configured for use with a mattress having a thickness of about fourteen inches or more. Accordingly, in this illustrative embodiment the visual indicia 124,(125) includes the text "8" 9", 10", 11", 12", 13", and 14"," with each of these indicium being aligned with an aperture of the plurality of leg extension apertures 119,(120) on a one-to-one basis. The lowermost aperture has the indicium "8" 9"" positioned nearby, while the second lowermost aperture has the indicium "10"" nearby. The third lowermost aperture has the indicium "11"" positioned nearby, while the third uppermost aperture has the indicium "12"" nearby. The penultimate uppermost aperture has the indicium "13"" positioned nearby, while the uppermost aperture has the indicium "14"" positioned adjacent thereto. These visual indicia 124,(125) advantageously indicate a predefined height that the upper cross bar of the handle bar 101 will extend above a mattress having a thickness identified by each indicium.

Figure 8:
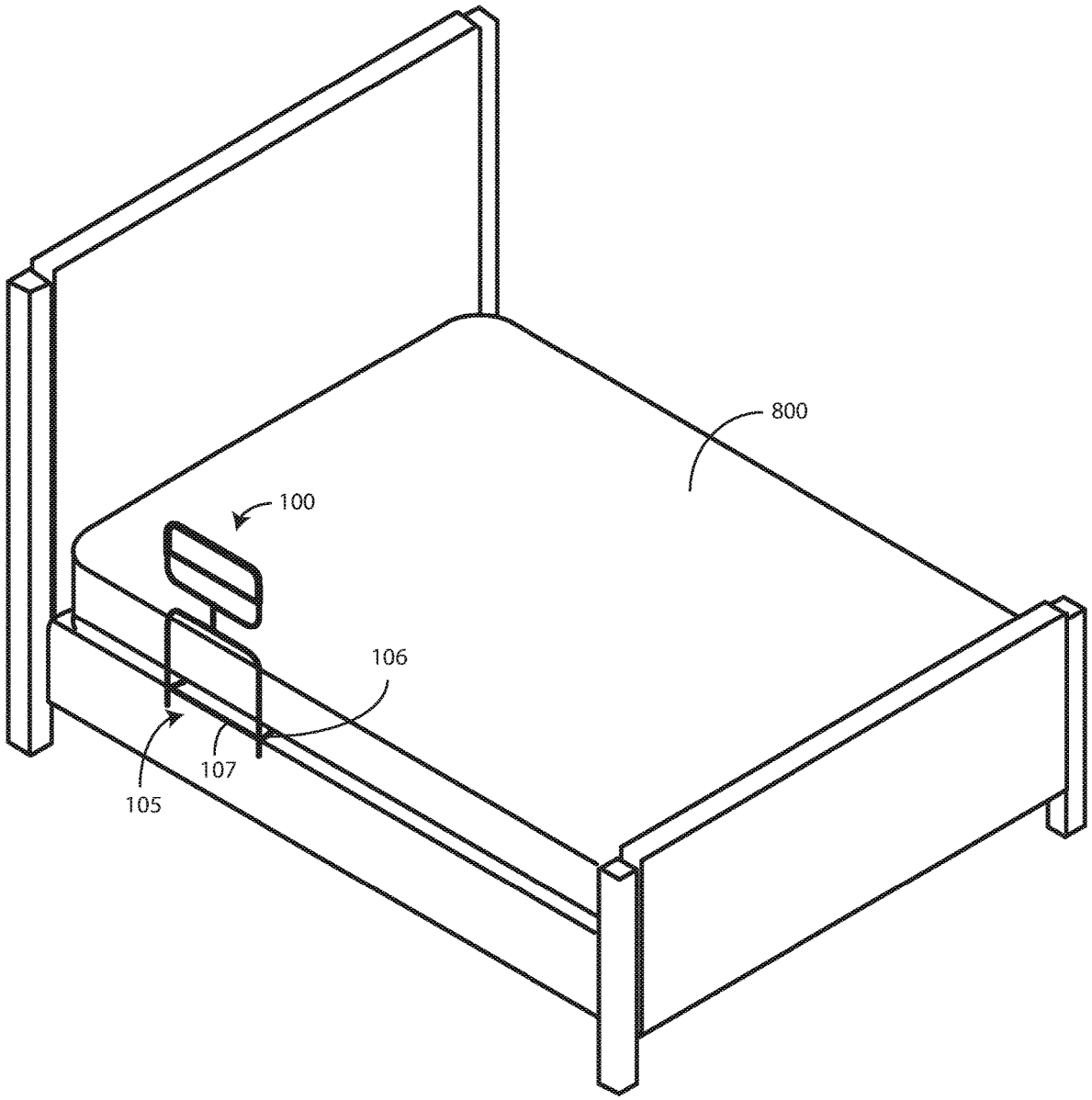
FIG. 8 illustrates one explanatory system in accordance with one or more embodiments of the disclosure.

As shown in FIG. 8, in one or more embodiments, the base 105 defined by the U-bar 106 and cross bar 107 is tucked under a mattress 800 when the bed assist bar 100 is in use. To ensure that the bed assist bar 100 remains securely in place during such use, in one or more embodiments additional components can be attached to the bed assist bar 100.

Figure 9:
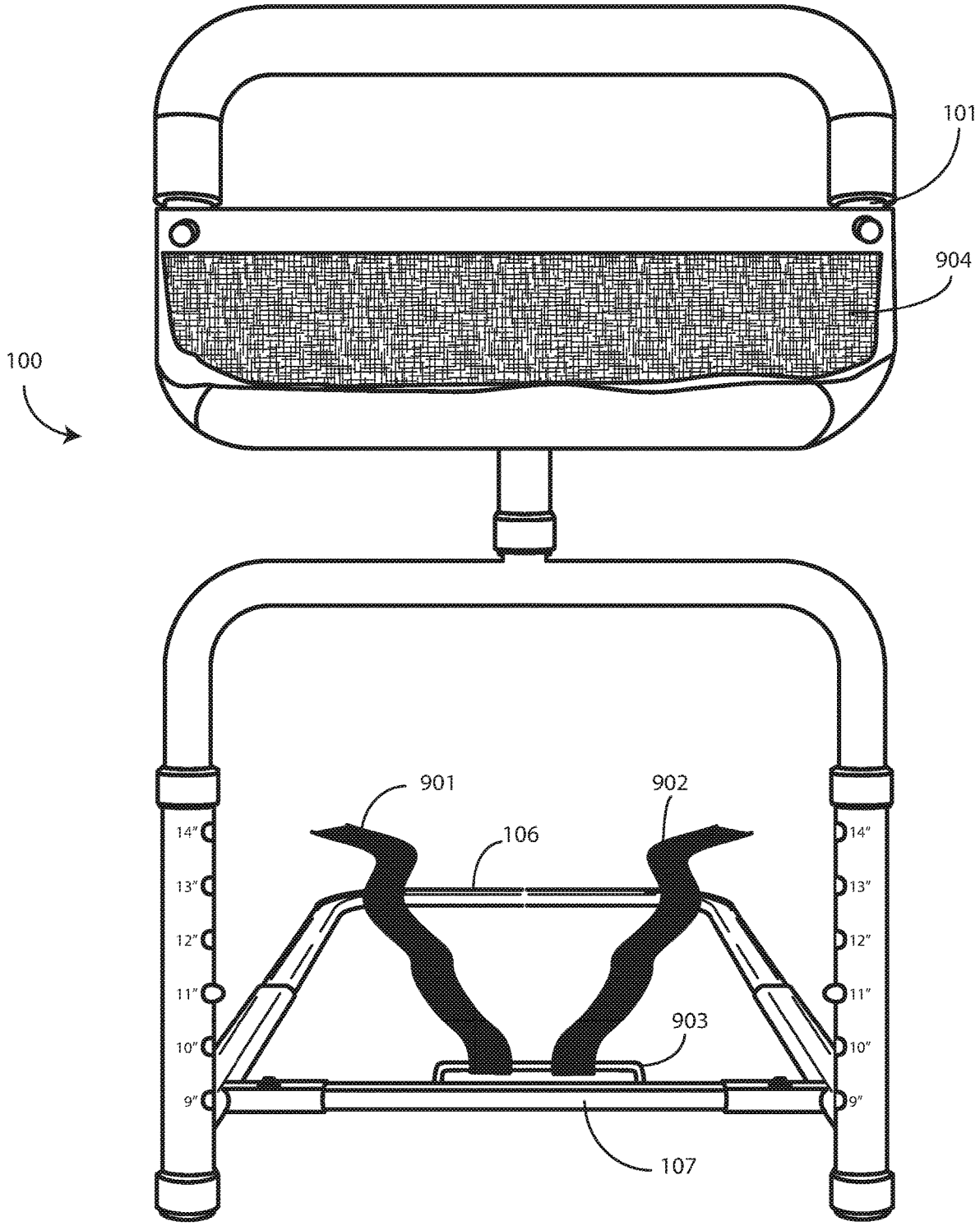
FIG. 9 illustrates another explanatory bed assist bar in accordance with one or more embodiments of the disclosure.

For example, turning now to FIG. 9, in one or more embodiments one or more straps 901,902 can optionally be coupled to one or more of the U-bar 106, the cross bar 107, a U-loop 903 attached to the cross bar 107, or other feature. Where included, these straps 901,902 can wrap about the frame and/or box spring of the bed to keep the bed assist bar 100 securely in place.

In one or more embodiments, other accessories or other components can be attached to the bed assist bar 100 as well. Illustrating by example, the bed assist bar 100 of FIG. 9 includes a storage pouch 904 coupled to the cross bar and bottom bar of the handle bar 101. Such a storage pouch 904 can be used to stow small accessories, electronic devices such as cell phones, personal items, and so forth. White noise machines or other sleep aids can also be stowed within the storage pouch 904. While shown attached to the cross bar and bottom bar of the handle bar 101 in FIG. 9, these accessories can be attached in other locations as well. For example, the storage pouch 904 could alternatively be attached to the mid-frame 102 or another location along the bed assist bar 100. Additionally, other accessories suitable for attachment to the bed assist bar 100 in addition to the storage pouch 904 will be obvious to those of ordinary skill in the art having the benefit of this disclosure.

Figure 10:
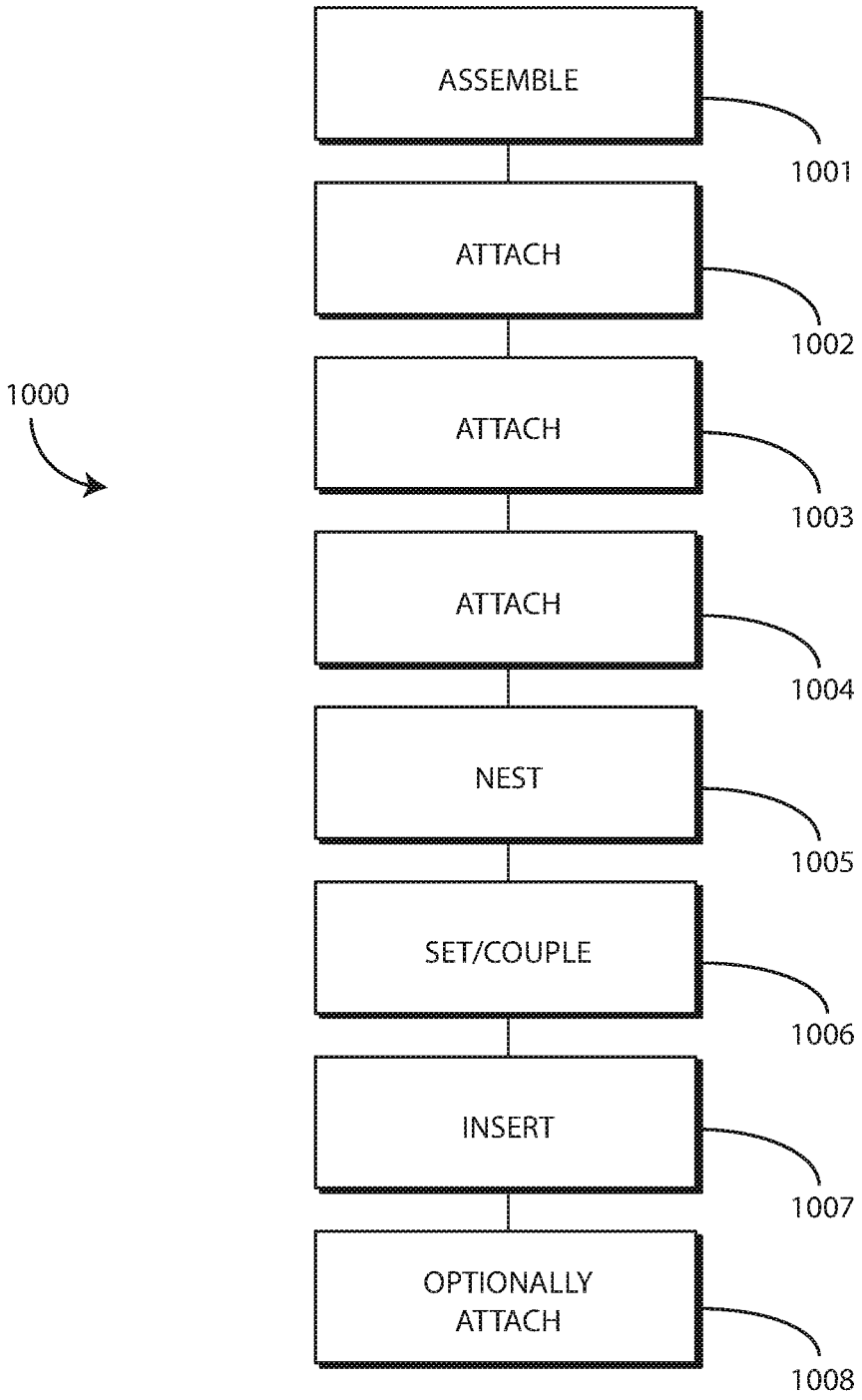
FIG. 10 illustrates one explanatory method for assembling one explanatory bed assist bar in accordance with one or more embodiments of the disclosure.

Turning now to FIG. 10, illustrated therein is one explanatory method 1000 for manufacturing a bed assist bar in accordance with one or more embodiments of the disclosure. Step 1001 includes assembling the twist-lock mechanism sub-assembly. In one or more embodiments, step 1001 begins with obtaining a rotating pin, an anchor insert, a spring, a washer, and a fastener such as a hex nut. Step 1001 then includes passing the shaft of the rotating pin through the central bore of the anchor insert and then through the spring and washer. Step 1001 then includes engaging the coupler with the end of the shaft of the rotating pin. For example, where the coupler is a hex nut, step 1001 can comprise engaging the threaded end of the shaft with the hex nut. When so assembled, the spring is preloaded to bias the head of the rotating pin toward the anchor insert as previously described.

Step 1002 then comprises attaching the twist-lock mechanism sub-assembly to the single stem of a mid-frame. In one or more embodiments, step 1002 comprises situating the twist-lock mechanism sub-assembly within a bore of the single stem of the mid-frame. Where the upper member of the twist-lock mechanism sub-assembly includes one or more stops extending distally away from a lower surface of the upper member along the outer surface of the lower member of the anchor insert, step 1002 can include positioning the twist-lock mechanism sub-assembly within the bore defined by the single stem of the mid-frame with the stop situated within a recess defined by a terminal edge of the single shaft extending from the mid-frame. By situating within a recess, the stop prevents the twist-lock mechanism sub-assembly from pivoting relative to the mid-frame.

In one or more embodiments, step 1002 also comprises coating the lower member of the twist-lock mechanism sub-assembly with an adhesive to fixedly retain the twist-lock mechanism sub-assembly within the single stem of the mid-frame. Alternatively, step 1002 can include fictionally fitting, such as with a rubber gasket, the lower member of the twist-lock mechanism sub-assembly within the single stem of the mid-frame. Step 1002 can alternatively include using bolts, pins, or other fasteners to fixedly attach the twist-lock mechanism sub-assembly to the mid-frame.

Step 1003 then comprises situating a single stem of a handle bar around the upper member of the twist-lock mechanism sub-assembly and attaching the rotating pin of the twist-lock mechanism sub-assembly to the single stem of the handle bar. In one or more embodiments, step 1003 comprises positioning a bore defined by the single stem of the handle bar about the upper member of the twist-lock mechanism sub-assembly with an aperture of the single stem of the handle bar aligned with an aperture of the rotating pin. Step 1003 can then include inserting a coupling pin into the aperture defined by the single stem of the handle bar such that the coupling pin sits within recesses of the upper member of the twist-lock mechanism sub-assembly. Passing the coupling pin through both apertures fixedly couples the head of the rotating pin to the single shaft of the handle bar. Step 1003 can optionally include positioning a tubing cuff about the portions of the single stem of the handle bar and the single stem of the mid-frame as well.

At step 1004, a foam grip can optionally be attached to the handle bar for user comfort. In one or more embodiments, step 1004 comprises attaching the foam grip to the upper cross bar of the handle bar. Step 1004 can alternatively include attaching a covering to the upper support of the handle bar. For example, a rubber foam or sponge type coating can be applied as the covering to make the handle bar softer and more comfortable for a user. Step 1004 can also include incorporating perspiration absorbing materials, antimicrobial materials, friction increasing materials, or other materials into the covering as well.

At step 1005, the mid-frame extensions of the mid-frame are nested within the legs of the bed assist bar. In one or more embodiments, when nested, the mid-frame extensions are able to translate within the legs to allow height-adjustability of the handle bar.

In one or more embodiments, step 1006 comprises using a coupler to fix the mid-frame extensions at a predefined location within the legs. For example, step 1006 can include sliding the mid-frame extensions to a desired position and using a coupler to fix them there. Where the coupler is the retaining clip step 1006 can include aligning an aperture of the mid-frame extensions with an aperture on the leg and inserting the engagement post into both apertures. Where the coupler is a push button, step 1006 can include allowing the push button to protrude (or click) into a respective aperture of the plurality of leg extension apertures to lock the substantially mid-frame extensions relative to the legs, and so forth.

Step 1007 comprises inserting upper legs of a U-bar into U-bar receivers attached to the legs. Step 1007 can also comprise inserting a cross bar into cross bar receivers attached to the legs. These components can be held within their respective receivers frictionally or via one or more fastening devices.

Optional step 1008 can include attaching one or more accessories to the bed assist bar. For example, in one or more embodiments step 1008 comprises attaching a storage pouch for small accessories and devices to the handle bar, the mid-frame, or another location along the bed assist bar. Step 1008 can also include attaching one or more straps to one or more of the U-bar, the cross bar, a U-loop attached to the cross bar, or other feature. Where included these straps can wrap about the frame and/or box spring of the bed to keep the bed assist bar securely in place.

Figure 12:
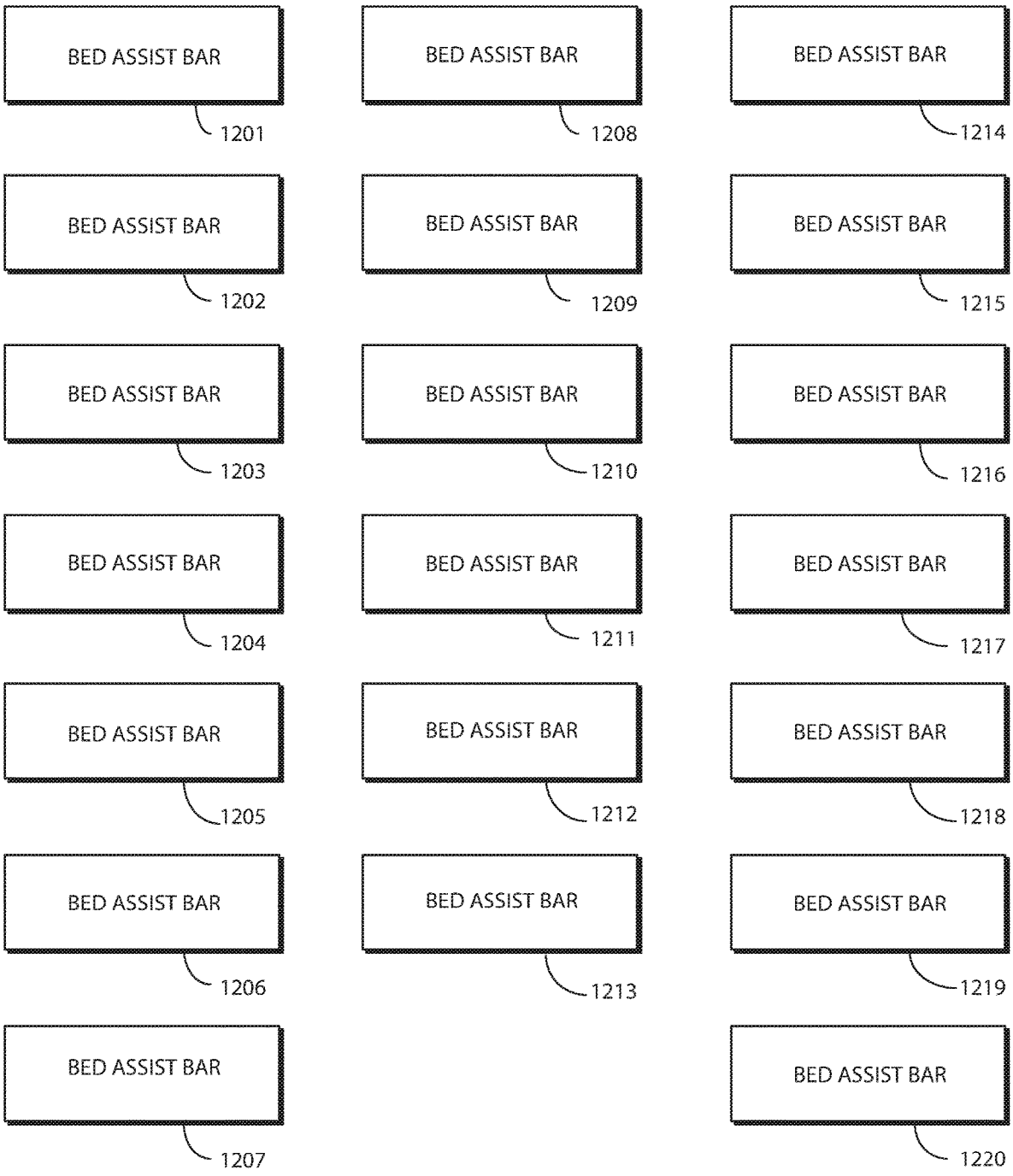
FIG. 12 illustrates various embodiments of the disclosure.

Turning now to FIG. 12, illustrated therein are various embodiments of the disclosure. The embodiments of FIG. 12 are shown as labeled boxes in FIG. 12 due to the fact that the individual components of these embodiments have been illustrated in detail in FIGS. 1-11, which precede FIG. 12. Accordingly, since these items have previously been illustrated and described, their repeated illustration is no longer essential for a proper understanding of these embodiments. Thus, the embodiments are shown as labeled boxes.

At 1201, a bed assist bar comprises an undercarriage, a mid-frame attached to the undercarriage, and a handle bar. At 1201, the handle bar is selectively pivotable between a first position locking the handle bar in a substantially parallel orientation relative to the mid-frame and a second position locking the handle bar being in a substantially orthogonal orientation relative to the mid-frame.

At 1202, the bed assist bar of 1201 further comprises a twist-lock mechanism sub-assembly coupled between the handle bar and the mid-frame. At 1203, the twist-lock mechanism sub-assembly of 1202 comprises a rotating pin, an anchor insert, a spring, and a fastener.

At 1204, the anchor insert of 1203 comprises an upper member defining a plurality of recesses and a lower member. At 1204, the upper member and lower member further define a central bore through the anchor insert.

At 1205, the rotating pin of 1204 comprises a head having one or more pins and a shaft extending distally therefrom. At 1205, major axes of the one or more pins and the shaft are oriented in another substantially orthogonal orientation.

At 1206, the shaft of the rotating pin of 1205 is situated within the central bore of the anchor insert with the spring biasing the head of the rotating pin toward the upper member of the anchor insert. At 1207, the one or more pins of 1206 are able to situate within recesses of the plurality of recesses in 90-degree increments.

At 1208, the mid-frame of 1207 comprises a first single stem extending therefrom. At 1209, the handle bar comprises a second single stem extending therefrom and engaging the first single stem of the mid-frame. At 1208, the upper member of the twist-lock mechanism sub-assembly is situated within the second single stem and the lower member of the twist-lock mechanism sub-assembly is situated within the first single stem. At 1209, translation of the handle bar of 1208 away from the mid-frame releases the one or more pins from the recesses of the plurality of recesses, thereby allowing the handle bar to pivot relative to the mid-frame.

At 1210, the bed assist bar of 1202 further comprises a storage pouch coupled to the handle bar. At 1211, the bed assist bar of 1210 further comprises one or more straps coupled to the bed assist bar.

At 1212, a bed assist bar comprises an undercarriage and a handle bar. At 1212, a mid-frame is coupled between the undercarriage and the handle bar. At 1212, the handle bar is selectively pivotable relative to the mid-frame between a first locked position and a second locked position oriented substantially orthogonally with the first locked position.

At 1213, the undercarriage of 1212 comprises a first leg and a second leg. At 1213, the mid-frame comprises a first mid-frame extension inserted into the first leg and a second mid-frame extension inserted into the second leg.

At 1214, each of the first leg and the second leg of 1213 define a plurality of apertures. At 1215, the bed assist bar of 1214 further comprises visual indicia identifying a predefined height that an upper cross bar of the handle bar will extend above a mattress having a thickness identified by each indicium of the visual indicia.

At 1216, the bed assist bar of 1212 further comprises a twist-lock mechanism sub-assembly comprising a rotating pin comprising a head coupled to one of the handle bar or the mid-frame, and an anchor insert having a lower member coupled to another of the handle bar or the mid-frame. At 1216, the head is spring biased toward the anchor insert.

At 1217, the anchor insert of 1216 further comprises an upper member defining one or more recesses. At 1217, the rotating pin comprises one or more pins configured to situate within the one or more recesses in a rest position.

At 1218, translation of the rotating pin of 1217 away from the anchor insert releases the one or more pins from the one or more recesses. At 1218, this allows the handle bar to selectively pivot relative to the mid-frame between the first locked position and the second locked position.

At 1219, a bed assist bar comprises a handle bar comprising a single stem extending distally from the handle bar. At 1219, the bed assist bar comprises a mid-frame comprising another single stem extending distally from the mid-frame and engaging the single stem extending distally from the handle bar. At 1219, a twist-lock mechanism sub-assembly is coupled to the single stem extending from the handle bar and to the other single stem extending from the mid-frame.

At 1219, the twist-lock mechanism sub-assembly facilitates a selective pivotability of the handle bar relative to the mid-frame between a first position locking the handle bar in a substantially parallel orientation relative to the mid-frame and a second position locking the handle bar being in a substantially orthogonal orientation relative to the mid-frame. At 1220, the twist-lock mechanism sub-assembly of 1219 comprises an anchor insert coupled to the another single stem extending distally from the mid-frame and a rotating pin coupled to the single stem extending from the handle bar and spring biased toward the anchor insert.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A bed assist bar, comprising:

an undercarriage;

a mid-frame attached to the undercarriage;

a handle bar that is selectively pivotable when lifted between a first position locking the handle bar in a substantially parallel orientation relative to the mid-frame and a second position locking the handle bar being in a substantially orthogonal orientation relative to the mid-frame; and a twist-lock mechanism sub-assembly coupled between the handle bar and the mid-frame, the twist-lock mechanism sub-assembly comprising a rotating pin, an anchor insert, a spring, and a fastener, the anchor insert comprising an upper member defining a plurality of recesses and a lower member, the upper member and lower member further defining a central bore through the anchor insert, the rotating pin comprising a head having one or more pins and a shaft extending distally therefrom, wherein major axes of the one or more pins and the shaft are oriented in another substantially orthogonal orientation;

wherein:

the mid-frame is positioned between the undercarriage and the handle bar; and the shaft of the rotating pin is situated within the central bore of the anchor insert with the spring biasing the head of the rotating pin toward the upper member of the anchor insert.

2. The bed assist bar of claim 1, further comprising a covering attached to an upper support of the handle bar.

3. The bed assist bar of claim 2, the covering comprising a sponge coating.

4. The bed assist bar of claim 2, the covering comprising a rubber foam coating.

5. The bed assist bar of claim 2, the covering comprising antimicrobial materials.

6. The bed assist bar of claim 5, the mid-frame comprising one or more mid-frame extensions engaging one or more legs.

7. The bed assist bar of claim 1, wherein the one or more pins are able to situate within recesses of the plurality of recesses in 90-degree increments.

8. The bed assist bar of claim 7, the mid-frame comprising a first single stem extending therefrom, the handle bar comprising a second single stem extending therefrom and engaging the first single stem of the mid-frame, wherein the upper member of the twist-lock mechanism sub-assembly is situated within the second single stem and the lower member of the twist-lock mechanism sub-assembly is situated within the first single stem.

9. The bed assist bar of claim 8, wherein translation of the handle bar away from the mid-frame releases the one or more pins from the recesses of the plurality of recesses, thereby allowing the handle bar to pivot relative to the mid-frame.

10. The bed assist bar of claim 2, further comprising a storage pouch coupled to the handle bar.

11. The bed assist bar of claim 10, further comprising one or more straps coupled to the bed assist bar.

12. A bed assist bar, comprising:

an undercarriage;

a handle bar;

a mid-frame coupled between the undercarriage and the handle bar; and a twist-lock mechanism sub-assembly comprising a rotating pin comprising a head coupled to one of the handle bar or the mid-frame, and an anchor insert having a lower member coupled to another of the handle bar or the mid-frame, wherein the head is spring biased toward the anchor insert;

wherein the handle bar is selectively pivotable relative to the mid-frame about a vertical axis between a first locked position and a second locked position oriented substantially orthogonally with the first locked position.

13. The bed assist bar of claim 12, the undercarriage comprising a first leg and a second leg, the mid-frame comprising a first mid-frame extension inserted into the first leg and a second mid-frame extension inserted into the second leg.

14. The bed assist bar of claim 13, each leg of the first leg and the second leg defining a plurality of apertures.

15. The bed assist bar of claim 14, further comprising visual indicia identifying a predefined height that an upper cross bar of the handle bar will extend above a mattress having a thickness identified by each indicium of the visual indicia.

16. The bed assist bar of claim 12, the mid-frame comprising one or more legs having visual indicia included therealong.

17. The bed assist bar of claim 12, the anchor insert further comprising an upper member defining one or more recesses, the rotating pin comprising one or more pins configured to situate within the one or more recesses in a rest position.

18. The bed assist bar of claim 17, wherein translation of the rotating pin away from the anchor insert releases the one or more pins from the one or more recesses, thereby allowing the handle bar to selectively pivot relative to the mid-frame between the first locked position and the second locked position.

19. The bed assist bar of claim 12, the undercarriage comprising a U-bar.

20. The bed assist bar of claim 12, the undercarriage further comprising a cross bar.

* * * * *